US007490553B2

(12) United States Patent
Magnan et al.

(10) Patent No.: US 7,490,553 B2
(45) Date of Patent: Feb. 17, 2009

(54) PYROTECHNIC SAFETY DEVICE OF REDUCED DIMENSIONS

(75) Inventors: Pierre Magnan, Saint Palais (FR); Renaud Lafont, Bourges (FR)

(73) Assignee: Giat Industries, Versailles (FR)

( * ) Notice: Subject to any disclaimer, the term of this patent is extended or adjusted under 35 U.S.C. 154(b) by 52 days.

(21) Appl. No.: 11/585,291

(22) Filed: Oct. 23, 2006

(65) Prior Publication Data

US 2007/0131127 A1 Jun. 14, 2007

(30) Foreign Application Priority Data

Oct. 27, 2005 (FR) ..... 05 11120

(51) Int. Cl.
*F42C 15/34* (2006.01)

(52) U.S. Cl. ..... 102/254; 102/222

(58) Field of Classification Search ..... 102/254, 102/221–222, 262

See application file for complete search history.

(56) References Cited

U.S. PATENT DOCUMENTS

| | | | | |
|---|---|---|---|---|
| 3,750,589 | A * | 8/1973 | Egli et al. | 102/237 |
| 5,206,457 | A | 4/1993 | Pascal et al. | |
| 6,167,809 | B1 * | 1/2001 | Robinson et al. | 102/235 |
| 6,431,071 | B1 * | 8/2002 | Hodge et al. | 102/254 |
| 6,564,716 | B1 * | 5/2003 | Steele et al. | 102/239 |
| 6,622,629 | B2 * | 9/2003 | Hodge et al. | 102/235 |
| 6,634,301 | B1 * | 10/2003 | Mulinix | 102/336 |
| 6,691,513 | B1 | 2/2004 | Kolesar | |
| 7,051,656 | B1 * | 5/2006 | Koehler et al. | 102/249 |
| 7,069,861 | B1 * | 7/2006 | Robinson et al. | 102/222 |
| 7,322,294 | B1 * | 1/2008 | Laib | 102/254 |
| 7,412,928 | B2 * | 8/2008 | Combes et al. | 102/222 |
| 2003/0070571 | A1 * | 4/2003 | Hodge et al. | 102/221 |
| 2004/0027029 | A1 | 2/2004 | Borwick, III et al. | |
| 2005/0139577 | A1 | 6/2005 | Kim et al. | |
| 2007/0101888 | A1 * | 5/2007 | Magnan et al. | 102/254 |
| 2007/0131127 | A1 * | 6/2007 | Magnan et al. | 102/222 |

FOREIGN PATENT DOCUMENTS

| | | | |
|---|---|---|---|
| EP | 1 189 012 | A2 | 3/2002 |
| EP | 1189012 | A2 * | 3/2002 |
| EP | 1 559 986 | A1 | 8/2005 |
| EP | 1 559 987 | A1 | 8/2005 |
| EP | 1559986 | A1 * | 8/2005 |
| FR | 2 431 677 | A | 2/1980 |
| FR | 2 650 662 | | 2/1991 |
| FR | 2 801 099 | | 5/2001 |
| FR | 2801099 | A1 * | 5/2001 |
| WO | WO 2004/027832 | A2 | 4/2004 |

* cited by examiner

*Primary Examiner*—James S Bergin
*Assistant Examiner*—Michael D David
(74) *Attorney, Agent, or Firm*—Oliff & Berridge, PLC

(57) ABSTRACT

The invention relates to a firing safety device for a pyrotechnic device which incorporates a barrier blocking a transmission channel connecting an igniter and a pyrotechnic charge wherein the barrier comprises at least two elements able to move with respect to one another by the action of motor means between a safety position in which they cooperate to block the transmission channel and an armed position in which they free at least partially one part of the transmission channel, each barrier element alone being unable to block the channel.

12 Claims, 7 Drawing Sheets

PYROTECHNIC SAFETY DEVICE OF REDUCED DIMENSIONS

BACKGROUND OF THE INVENTION

1. Field of the Invention

The technical scope of the invention is that of firing safety devices for pyrotechnic devices.

2. Description of the Related Art

Safety devices (or SADs) are well known. They generally incorporate a barrier blocking a transmission channel which connects an igniter to a pyrotechnic charge.

The barrier thus positions itself in the way of the flame between the igniter and the charge thereby preventing the priming or firing of the latter.

Patents FR-2650662 and FR-2801099 thus disclose such known safety devices.

One of the problems encountered with these devices is their encumberment. The parts are relatively solid to ensure the interruption of the pyrotechnic train. The motor means enabling the barrier to be displaced must thus be powerful. More often than not, it is springs which are used, such springs remaining tensed during the storage phases possibly leading to a deterioration of their mechanical properties and a reduction in arming reliability.

Moreover, the springs do not enable an arming device with reversible function to be produced (that is to say, one which can move from its safety position to its armed position, and back again).

Small electric motors may be used, but these are cumbersome, fragile, difficult to integrate and require a substantial power source.

U.S. Pat. No. 3,750,589 discloses a safety and arming device which is activated by centrifugal force.

This device comprises several discs which are housed in a chamber that fills up with a fluid after firing. Each disc incorporates a channel, the centrifugal force causing the discs to be displaced with respect to one another in the fluid and the geometric characteristics of each disc are defined such that, after such a displacement, the different channels of each disc are aligned and form a continuous axial transmission channel between a primer and explosive charge.

The functioning of such a device is both complex and difficult to reproduce. Moreover, each disc constitutes in itself a barrier which must be displaced from a safety position in which it blocks the transmission channel to an armed position in which its hole is aligned with this channel.

Such a solution does not enable the dimensions and mass of the device to be reduced.

SUMMARY OF THE INVENTION

The aim of the invention is to propose a firing safety device of reduced mass which is nevertheless reliable and efficient.

Thus, the invention relates to a firing safety device for a pyrotechnic device, such device incorporating a barrier blocking a transmission channel connecting an igniter and a pyrotechnic charge, such device wherein the barrier comprises at least two elements able to move with respect to one another by the action of motor means between a safety position in which they cooperate to block the transmission channel and an armed position in which they free at least partially one part of the transmission channel, each barrier element alone being unable to block the channel.

Advantageously, the barrier elements may be displaced radially with respect to the transmission channel, the elements being, in a safety position of the device, in mutual contact at a zone positioned opposite the transmission channel.

According to one embodiment, the barrier elements will incorporate profiles at their contact zone with a matching shape whose juxtaposition will constitute at least one deflector ensuring gastightness for the gases generated by the igniter.

According to a particular embodiment, the barrier elements will be in the shape of cylindrical sectors.

The device may thus incorporate four sector-shaped elements.

According to another embodiment, the barrier elements may be substantially parallelepipedic in shape, and the axis of the transmission channel will pass through their transversal plane with the smallest section.

According to another embodiment, the barrier elements may be positioned one on top of the other and opposite the transmission channel, each element incorporating slots separated by tongues, the tongues of a first element blocking the slots in the second element when the device is in a safety position and the tongues uncovering the slots when the device is in the armed position.

Preferably, the transmission channel will have a section whose surface area will be less than or equal to 1 $mm^2$ whilst being greater than the priming surface of the pyrotechnic charge.

According to a particular embodiment, the elements and their motor means will be made in the form of micro-machined or micro-engraved parts, added onto or made in a board of a substrate.

The safety device may thus incorporate at least two micro-machined or micro-engraved boards stacked one on top of the other, control means ensuring a synchronized displacement of the elements of the different boards.

BRIEF DESCRIPTION OF THE DRAWINGS

The invention will become more apparent from the following description of different embodiments, such description made with reference to the appended drawings, in which.

DETAILED DESCRIPTION OF PREFERRED EMBODIMENTS

Figure 1:
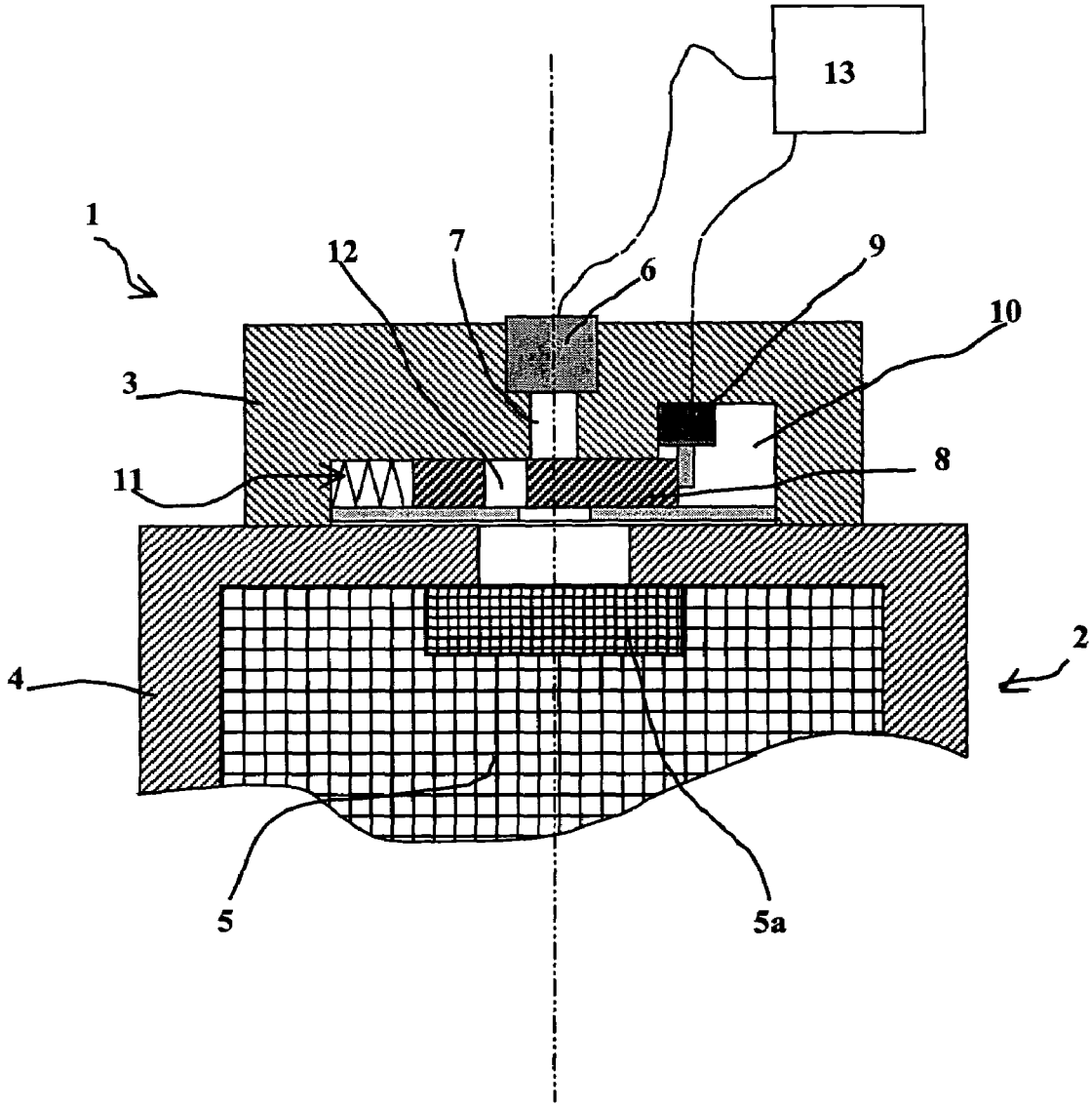
FIG. 1 shows a safety device according to prior art.

With reference to FIG. 1, a firing safety device 1 for a pyrotechnic device 2 according to prior art incorporates a case 3 that is fixed by means (not shown) onto the casing 4 of the pyrotechnic device 2.

The casing 4 encloses a pyrotechnic charge 5 (for example an explosive onto which a priming relay 5*a* is positioned) and the safety device 1 has an igniter 6. The igniter 6 is connected to the explosive relay 5 by a transmission channel 7.

A mobile barrier 8 blocks the transmission channel 7 and prevents the charge 5, 5*a* from being ignited by the igniter 6.

The device 1 is shown in FIG. 1 in its safety position.

The barrier 8 is held in this safety position by an electrically controlled lock 9 (retractor). Once it is unlocked, the barrier 8 slides in its housing 10 by the action of the motor means 11, which here is a spring, and takes up the armed position.

In this armed position, the hole 12 in the barrier 8 is positioned opposite the transmission channel 7 and allows the charge 5, 5*a* to be ignited.

Electronic control means 13 are connected to the igniter 6 and the lock 9. They ensure, firstly, the control of the lock leading the device to become armed and secondly, the firing of the igniter 6.

The device is only armed further to the detection of a certain number of events which are necessarily associated with firing (for example firing acceleration for a projectile). It is means 13 which manage these events. These means are thus connected to sensors (not shown) and incorporate event management software.

Such a device is well known to someone skilled in the art. Naturally, FIG. 1 is only schematic and does not presume the dimensions and proportions of the different components shown.

Moreover, other solutions exist in which the lock is not controlled electronically but mechanically, further, for example, to the forces of inertia of a firing or through the detection using a probe of the exiting of a projectile from the launcher tube.

Patents FR-2650662 and FR-2801099 describe known devices.

The main drawback to this type of device is the long travel of the barrier 8. This travel is generally of about a few tens of mm and is linked to the dimensions adopted for the barrier.

Moreover, the barrier must have sufficient mechanical strength to ensure the interruption of the pyrotechnic train. Thus, when the device is in the safety position, firing the primer must not cause the charge 5, 5*a* to fire. The barrier must therefore effectively stop the pyrotechnic effect from the igniter 6.

It seems therefore somewhat contradictory to try to reduce the size of the barrier to reduce its travel whilst retaining an acceptable level of safety.

According to a first characteristic of the invention, the encumberment of the device is sought to be reduced by reducing the barrier's travel. To do this, the barrier will be divided into at least two elements able to move with respect to one another. The full arming travel of the barrier may thus be divided into several partial travels for each barrier element. None of the barrier elements alone will be able to block the transmission channel but the different barrier elements will cooperate to block this channel.

The travel required to unblock the channel may therefore be largely reduced.

Figure 2:
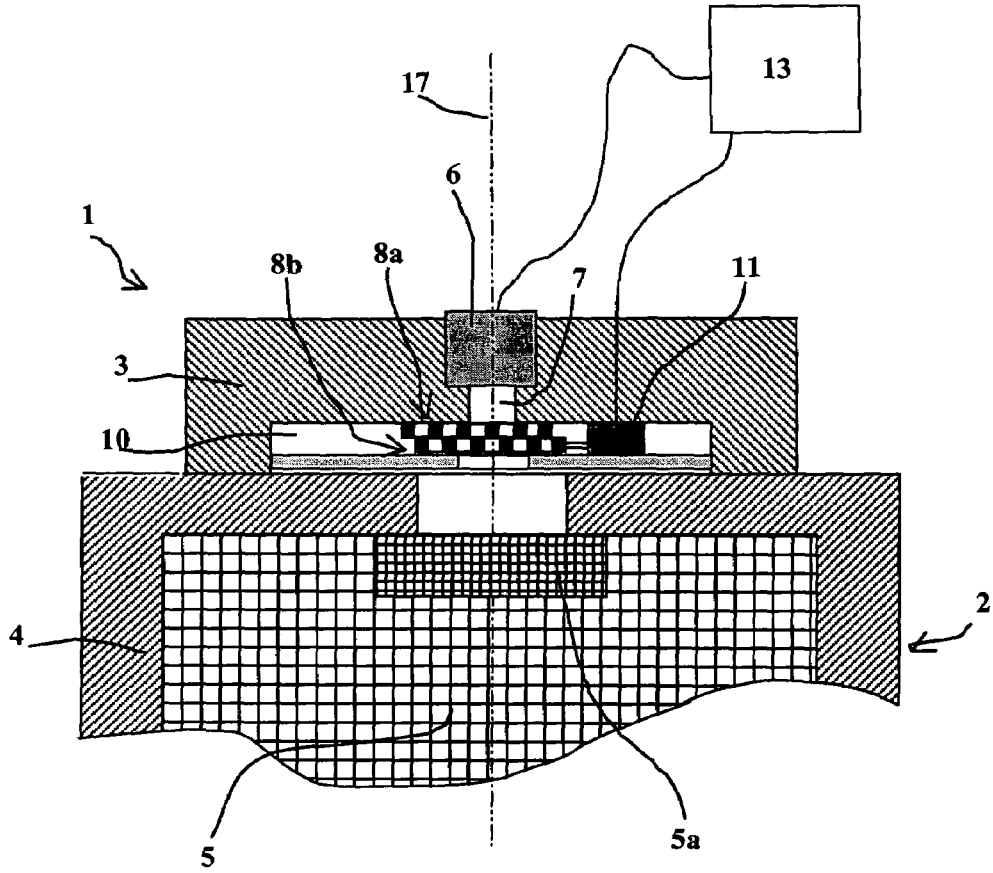
FIG. 2 shows a safety device according to a first embodiment of the invention.

FIG. 2 thus shows a first embodiment of the invention in which the barrier 8 incorporates two elements 8*a* and 8*b* which are positioned on top of one another opposite the transmission channel 7.

Element 8*a* is immobile (for example bonded to a bottom wall of the housing 10) whereas element 8*b* is mobile and is displaced by motor means 11 which here are a micro motor activated by the control means 13.

Naturally, the motor means may be replaced by a spring and a lock may be provided which would be released by the control means 13.

According to an important characteristic of this embodiment, each element 8*a* and 8*b* of the barrier incorporates slots 14*a* or 14*b* which are separated by tongues 15*a* or 15*b*.

Figure 3A:
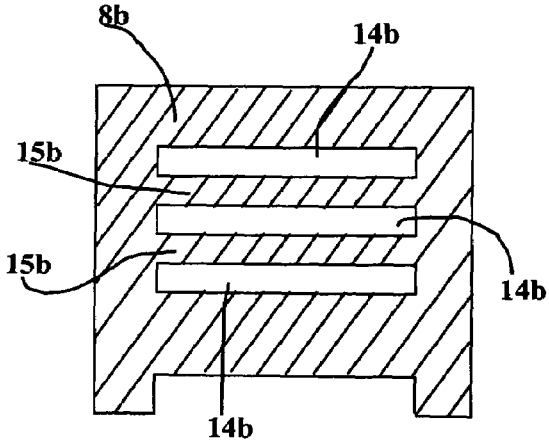
FIGS. 3*a* and 3*b* show, in isolation, the two barrier elements implemented in this first embodiment.
Figure 3B:
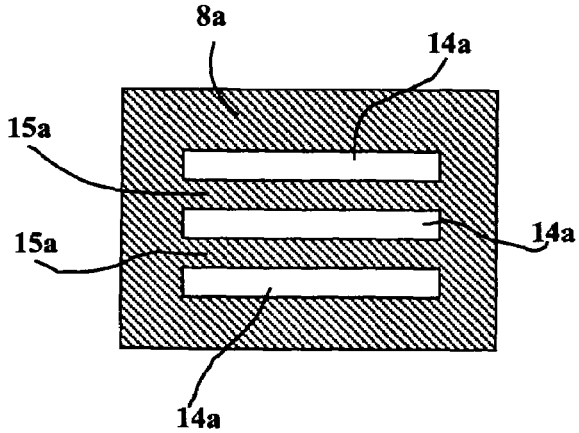

Elements 8*a* and 8*b* may be seen more particularly in FIGS. 3*a* and 3*b*. Slots 14*a* and 14*b* of each element 8*a* and 8*b* are of substantially the same dimensions. Tongues 15*a* and 15*b* are of substantially the same dimensions as the slots.

Figure 4A:
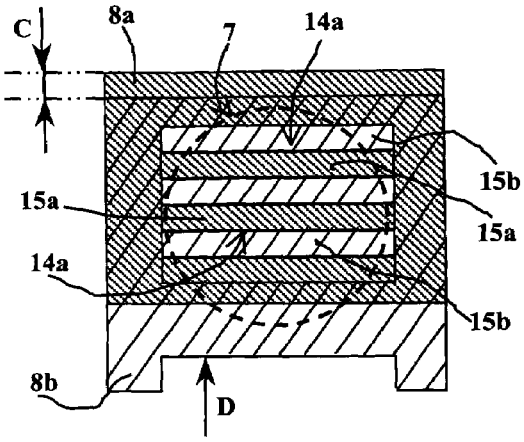
FIGS. 4*a* and 4*b* show the two superimposed barrier elements in the system's armed position (FIG. 4*b*) and in the system's safety position (FIG. 4*a*).
Figure 4B:
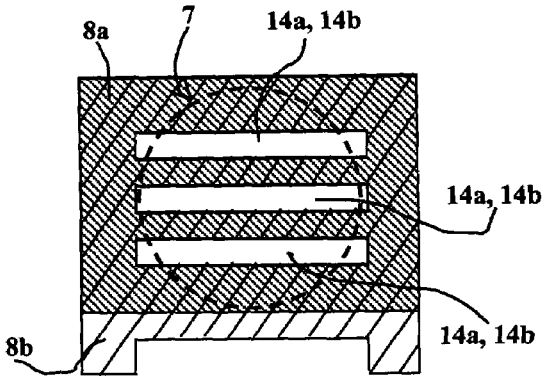

FIGS. 4*a* and 4*b* make it easier to understand the functioning of the shutter according to this embodiment.

In these Figures, the transmission channel 7 is drawn as a circle of dotted lines.

In FIG. 4*a* elements 8*a* and 8*b* are seen to be in their safety position. In this position, tongues 15*b* of element 8*b* block slots 14*a* of element 8*a*.

Gas leakage may be minimized thanks to the control of design play and manufacturing tolerances.

The transmission channel 7 is thus fully blocked.

When the device is being armed, the motor means 11 push element 8*b* in direction D. They push it along a travel C equal to the width of a tongue 15*a* or 15*b*.

Elements 8*a* and 8*b* thus adopt the armed position in FIG. 4*b*. In this position slots 14*a* of element 8*a* are opposite slots 14*b* of element 8*b*.

The transmission channel 7 is, in this case, partly blocked.

Someone skilled in the art will choose the number of slots 14 and will dimension them depending on the opening area required to ensure the ignition of the composition 5, 5*a* by the igniter 6. This area will naturally also depend on the area of the transmission channel 7 as well as on the pyrotechnic properties of the igniter 6 and the composition 5, 5*a*.

It is naturally also possible to vary the number and shape of the tongues 15 and slots 14.

We can see, therefore, that at a reduced travel C (=the width of a tongue 15) it is possible here for a section to be opened which is three times the area of an opening 14.

The travel will be all the more limited in that the width of a tongue 15 is reduced and thus the number of slots 14 increased for a given section of transmission channel.

The thickness and nature of the material forming elements 8*a*, 8*b* will naturally be chosen according to the properties of the igniter 6. Elements 8*a*, 8*b* may be made of steel or silicon.

Elements 8*a*, 8*b* may be of a width and length of around ten millimeters, which is two or three times less than that of known barriers.

According to a particular embodiment which will be detailed later, the elements may be of even smaller dimensions and will be advantageously made in the form of parts that are micro-machined or micro-engraved on a board of a substrate, for example an insulating substrate. This technology, known as MEMS (Micro Electro Mechanical System) indeed today enables micro mechanisms to be made by implementing a technique similar to that enabling electronic integrated circuits to be made.

Figure 5:
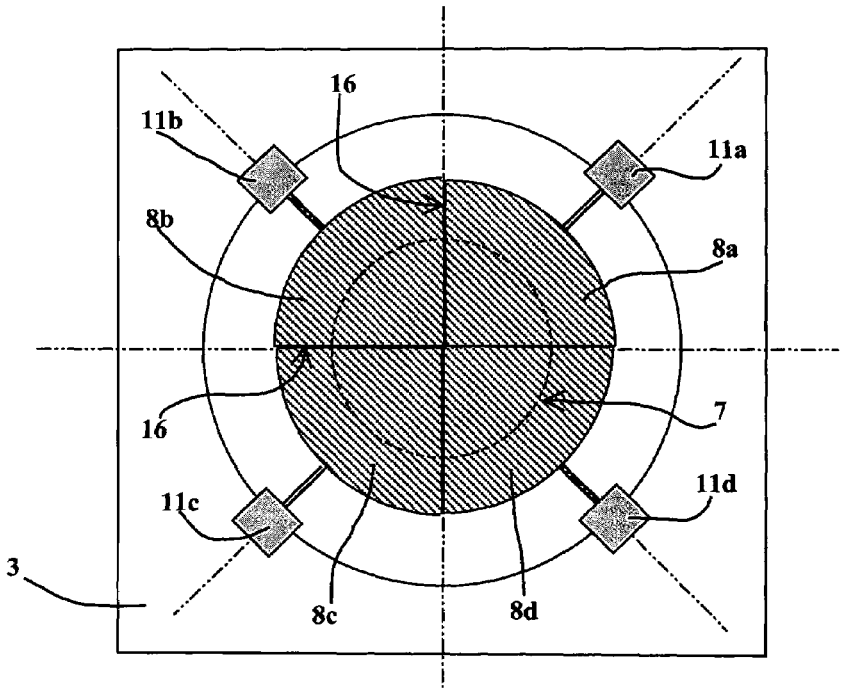
FIGS. 5 and 6 show a partial top view of a safety device according to a second embodiment of the invention, FIG. 5 showing the device in the safety position and FIG. 6 showing it in the armed position.
Figure 6:
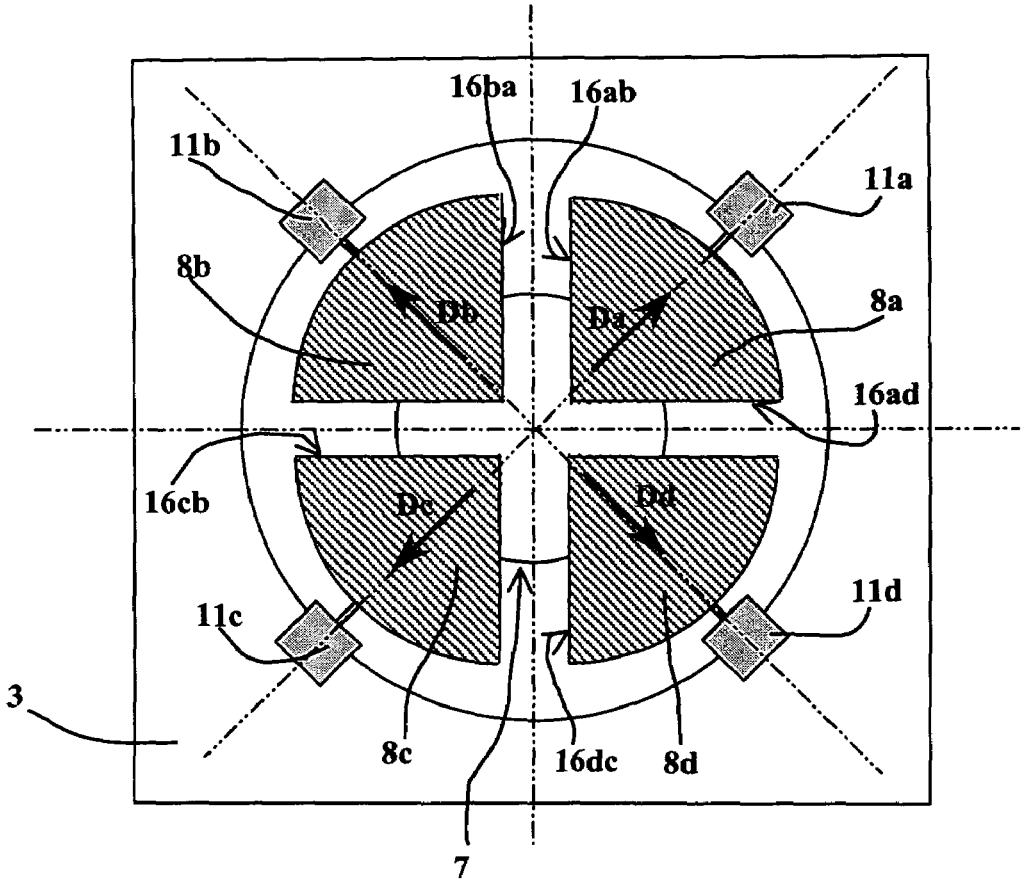

FIGS. 5 and 6 partially show a second embodiment of a safety device according to the invention.

This device is shown as a cross section and the transmission channel 7 appears in FIG. 5 in the shape of a circle of dotted lines.

The barrier 8 is here constituted by four sectors of cylinders each of 90°: 8*a*, 8*b*, 8*c*, 8*d*. These sectors are each delimited by orthogonal planes 16.

Each sector 8*a*, 8*b*, 8*c*, 8*d* may be radially displaced by motor means 11*a*, 11*b*, 11*c* or 11*d*.

The device is shown in FIG. 5 in its safety position in which the four sectors are joined two by two and fully block the transmission channel 7. The elements are in mutual contact by contact surfaces 16 which here are planes 16*ab*, 16*ad*, . . . 16*cb* (cf. FIG. 6).

When the elements are in the safety position, the different planes 16 are in contact in a zone positioned opposite the transmission channel 7.

We can see in FIG. 5 that these planes form a cross centered on the transmission channel 7.

The device is shown in FIG. 6 in its armed position in which each sector 8*a*, 8*b*, 8*c* and 8*d* has been radially displaced in directions Da, Db, Dc or Dd by the action of the motor means 11*a*, 11*b*, 11*c* or 11*d*.

The transmission channel 7 is thus partially unblocked.

We can see that each element 8*a*, 8*b*, 8*c* and 8*c* merely need to be displaced a relatively short distance to largely unblock the channel 7. We note thus that the displacements of the elements for a distance D that is slightly greater than the third of the channel's 7 radius have freed up an area of the channel 7 which is almost half its total area.

The movements required are thus of reduced amplitude thereby enabling a reduction in the size of the device and minimal energy storage for unlocking.

The dimensions of sectors 8 and the amplitude of the displacements D will be selected such that the unblocked area is enough to enable the ignition of the pyrotechnic charge 5, 5*a* by the igniter 6 (elements not shown in these Figures but located on either side of the channel 7).

The height of the different sectors 8*a*, 8*b*, 8*c* and 8*d* will naturally be chosen according to the characteristics of the igniter 6 and the charge 5, 5*a*.

The different motor means may be made in the form of electric micro motors or else in the form of springs. In the latter case, locking means will be provided which will ensure that the sectors are maintained in the safety position as shown in FIG. 5.

These locking means will be released to enable the device to arm. A single locking means may be provided for all the sectors or as many locking means may be provided as sectors.

Once again, the sectors may be made in the form of micro-machined or micro-engraved (MEMS) parts.

Figure 7:
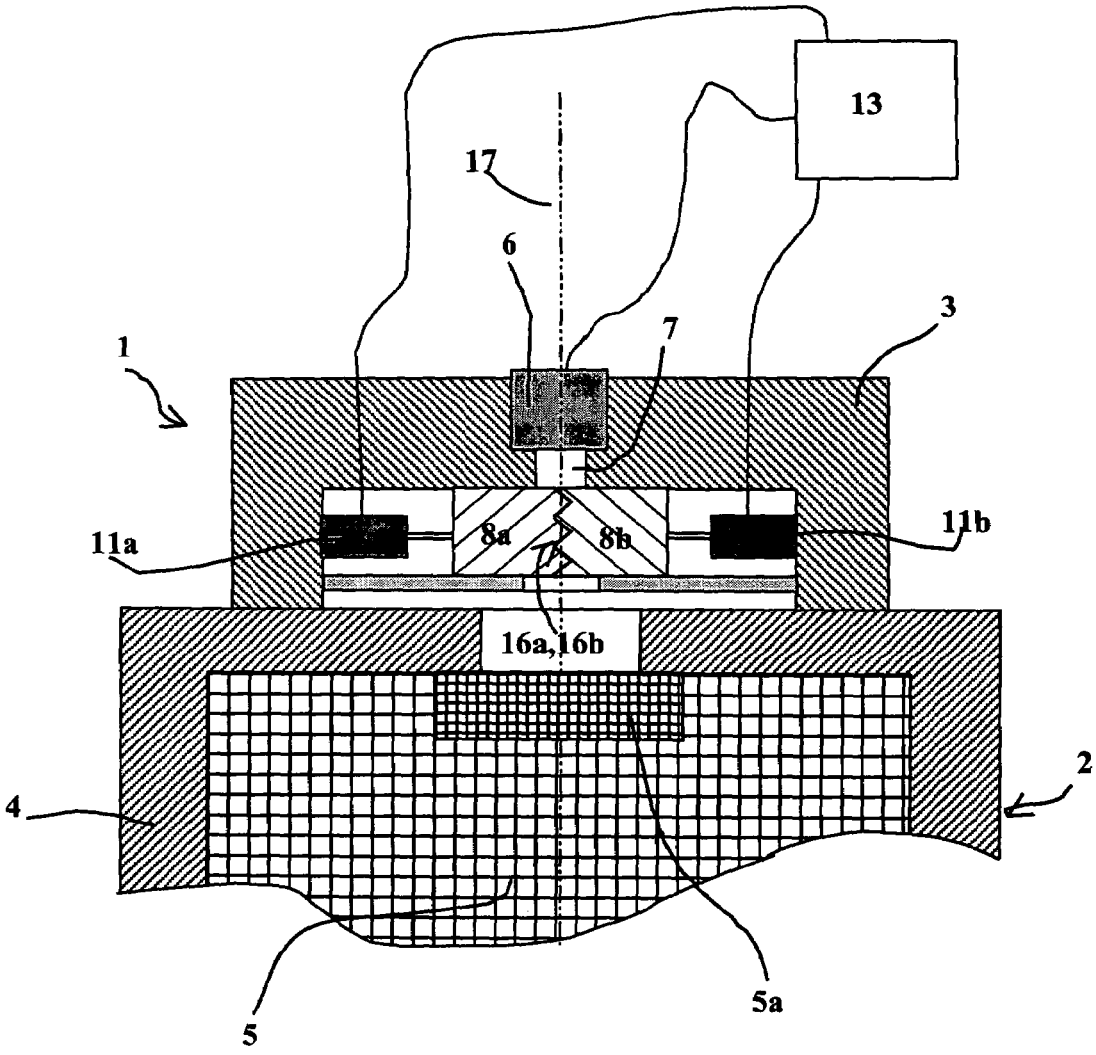
FIGS. 7 and 8 show a partial top view of a safety device according to a third embodiment of the invention, FIG. 7 showing the device in the safety position and FIG. 8 showing it in the armed position, FIG. 9 schematically shows the integration of the device according to this third embodiment in the form of a micro-machined chip.
Figure 8:
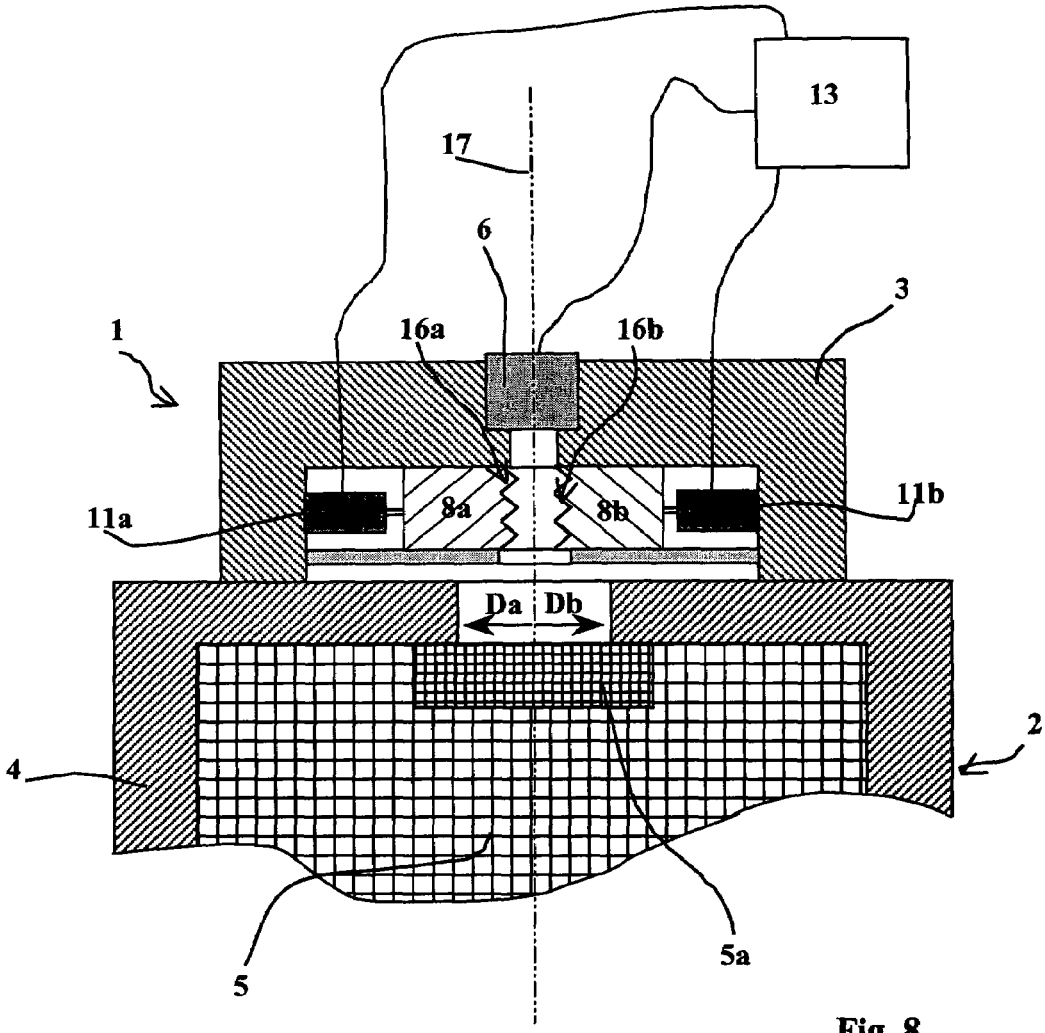

FIGS. 7 and 8 show a third embodiment of the invention.

In this embodiment, the barrier 8 is constituted by two elements 8*a* and 8*b* which are able to be displaced radially with respect to the transmission channel 7.

Elements 8*a* and 8*b* here are substantially parallelepipedic in shape and their thickness is greater than or equal to the diameter of the channel 7.

Each element 8*a*, 8*b* can be displaced by motor means 11*a*, 11*b* (here, electric micro motors connected to the control means 13).

In place of the micro motors 11 spring means may naturally be implemented and blocking devices may be used which would be activated by the control means 13.

Once again, when the device is in its safety position, elements 8*a*, 8*b* are in mutual contact at a zone which is positioned opposite the transmission channel 7.

Contact surfaces 16*a*, 16*b* here have matching profiles constituted by a succession of toothing delimited by planes inclined with respect to the axis 17 of the channel 7.

The juxtaposition of the toothing thus constitutes deflectors which improve gastightness with respect to the gases generated by the igniter 6.

FIG. 8 shows the device in its armed position. Each motor means has displaced an element in a direction Da or Db. The channel 7 is thus unblocked and the charge 5, 5*a* may be ignited.

Each element 8*a*, 8*b* is thus displaced by a distance substantially equal to the half-diameter of the channel. The movements are thus of reduced amplitude thereby enabling a reduction in the size of the device and minimal energy to ensure unlocking.

The different embodiments described above of the invention may be implemented using barriers whose dimensions are of around ten millimeters. These barriers can block a channel of around 10 mm in diameter.

In any event, the invention enables the size of the barrier to be reduced and the travel reduced.

According to a preferred embodiment of the invention, and as has been suggested by the description different embodiments, the dimensions of the different elements can be further reduced by using MEMS technology.

Thus, the barrier elements will be made in the form of parts that are micro-machined or micro-engraved on a substrate board, for example an insulating substrate.

MEMS technology is well known to someone skilled in the art. Reference may be made therefore to patents EP-1559986 and EP-1559987 which describe safety devices implementing MEMS. Generally, given their small size, the MEMS implemented in known safety devices use a mobile barrier to interrupt an optical firing signal. Such a barrier is thus not directly positioned between the pyrotechnic igniter and the charge, and the interruption of the pyrotechnic train is not ensured.

The invention, on the contrary, intends to implement a MEMS technology mobile barrier to directly and reliably interrupt the pyrotechnic ignition train between an igniter and a charge.

To obtain such a result it is necessary for the whole pyrotechnic train to be optimized and an igniter 6 to be implemented that is of the smallest size able to ensure functioning, such igniter being coupled with a suitable pyrotechnic relay 5*a* which is positioned on the side of the pyprotechnic charge 5.

It has been verified that by implementing an igniter incorporating an output stage of 10 milligrams of cyclonite coupled with a very insensitive relay, for example of HNS (hexanitrostilbene), it is possible to make a transmission channel 7 with a section of less than 1 $mm^2$ (channel diameter of around one mm) whilst ensuring the required ignition transmission. Note that classical igniters have an output stage of around 30 milligrams of cyclonite. The igniter 6 selected is thus of reduced power.

Indeed, the critical diameter of the HNS is of 0.5 mm and to be ignited this explosive thus requires a priming surface of approximately 0.2 $mm^2$ which is much less than the section of the transmission channel.

It has also been verified that it is possible to ensure the interruption of the pyrotechnic effect using a silicon barrier of around 3 mm in thickness, which can be produced using MEMS technology.

Thanks to the barrier configurations proposed by the invention and with a channel section of less than or equal to 1 $mm^2$, it is possible for the displacement of the barrier element to be limited to 0.5 mm maximum, which is also compatible with MEMS technologies.

Figure 9:
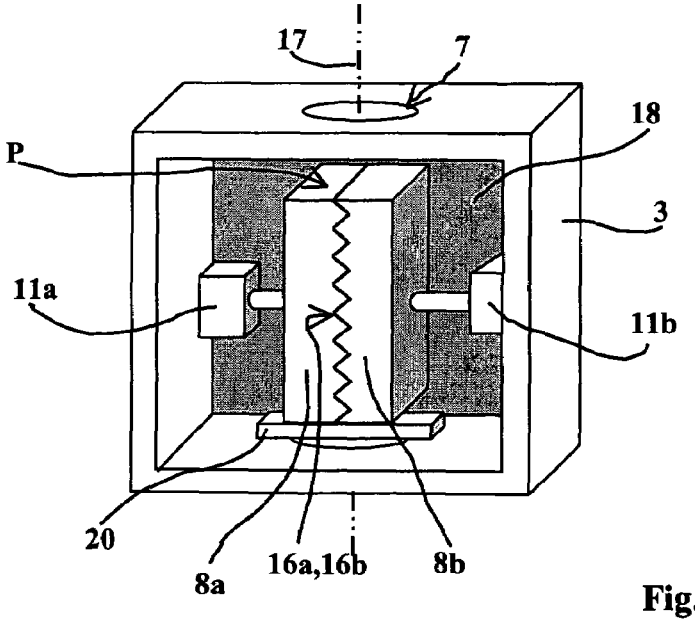

FIG. 9 schematizes a case 3 for such a MEMS component. The case encloses a substrate 18, for example insulating (in glass or silicon), onto which elements 8*a* and 8*b* are made in the form of micro-machined or micro-engraved parts. Elements 8*a* and 8*b* are here shown schematically and in their safety position. On their contact surfaces 16*a*, 16*b* they both have toothing profiles.

The elements are kept locked together by a micro-machined lock 20 which may, for example, be constituted by a thermal fuse or electro thermal or electromagnetic actuator.

Once unlocked, the elements move away from each other due to the action of the motor means 11*a* and 11*b* which will, for example, be micro-machined springs.

We can see in this Figure that elements 8*a* and 8*b* are substantially parallelepipedic in shape and that the axis 17 of the transmission channel 7 passes through their transversal plane P with the smallest section.

Thus, the barrier no longer receives the pyrotechnic effect in a direction oriented according to the thickness of the barrier, as it did in prior art, but in a direction which is parallel to the plane of displacement of the elements and which thus encounters one of the largest dimensions of the barrier.

It is thus possible for a micro-machined MEMS technology to be implemented whilst ensuring a length of silicon of around 3 mm between the igniter and the pyrotechnic charge. This length is enough to stop the pyrotechnic effects due to the inadvertent ignition of the igniter selected.

Moreover, the displacement of the elements is reduced and is of around 0.5 mm.

Someone skilled in the art will easily determine the structure of the different micro-machined elements. The electro thermal and electromagnetic actuators are well known in the field of MEMS. The same applies to the fuses and micro-machined springs. Reference may be made, for example, to patents EP-1573782, US2005139577, U.S. Pat. No. 6,691,513 and US2004027029 which disclose possible solutions.

It is also possible to put barrier elements that have already been micro-machined on another board onto a board carrying the micro-machined or micro-engraved motor means.

Generally, the thickness of the micro-machined elements does not exceed half a millimeter. To block a channel of a diameter of 1 m, it is therefore necessary to stack at least two micro mechanisms on top of one another.

Figure 10A:
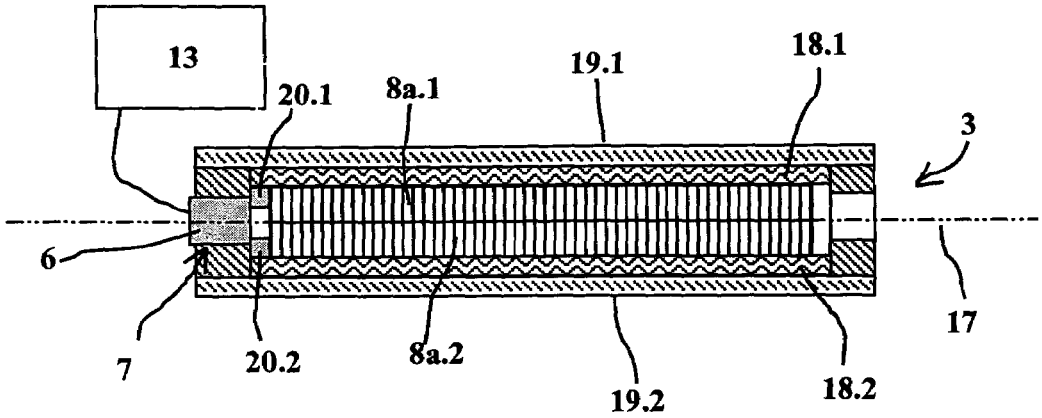
FIGS. 10*a* and 10*b* are two schematic views of the device according to the third embodiment, such device being made in the form of micro-machined chips, the device being shown along two orthogonal cross sections.
Figure 10B:
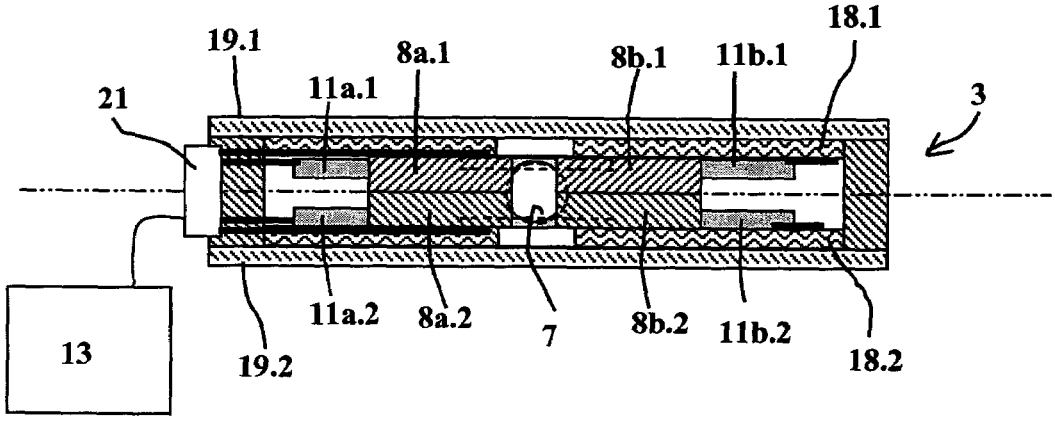

FIGS. 10*a* and 10*b* enable the structure of such a device associating two MEMS to be detailed.

Case 3 thus encloses two substrate boards 18.1 and 18.2, for example an insulating substrate, each bonded onto a glass support 19.1, 19.2.

Board 18.1 carries two mobile elements 8*a*.1 and 8*a*.1.

Similarly, board 18.2 carries two mobile elements 8*a*.2 and 8*b*.2.

Each element may be displaced by motor means 11*a*.1, 11*b*.1; 11*a*.2, 11*b*.2.

Locking means 20.1 or 20.2 ensure the immobilization, for each board, of the two barriers elements in question.

Slight play (a few microns) in the assembly will be provided to enable the conjunctive movements of elements 8 carried by the two boards.

Each board is connected to the electronic control means 13 which are designed to ensure the synchronized displacement of elements 8 of the different boards.

FIG. 10*b* shows a connector 21 that ensures the interface between the boards and the cable from the control means 13. Certain conductors carried by the boards 18.1, 18.2 have also been shown schematically in FIG. 10*b* in bold lines, such conductors connecting the elements and micro-machined actuators to the connector 21.

MEMS-based safety devices are described here which implement the embodiment shown in FIGS. 7 and 8.

It is naturally possible for the device according to other embodiments to be made in MEMS form.

With respect to the embodiment in FIG. 2, and according to the type of igniter used, several boards may be piled up to ensure the required barrier thickness.

The same applies to the embodiment in FIGS. 5 and 6. It is possible for boards to be stacked which each carries four sector-shaped elements. The movements of these different sectors will naturally be synchronized.

What is claimed is:

1. A firing safety device for a pyrotechnic device, said firing safety device including a barrier for blocking a transmission channel that connects an igniter and a pyrotechnic charge, and said barrier comprising:

at least two elements that move with respect to one another;

wherein the firing safety device further includes a motor that moves said at least two elements between a safety position in which said at least two elements cooperate to block said transmission channel, and an armed position in which said at least two elements free at least partially one part of said transmission channel, each of said at least two elements alone being unable to block said channel, and said at least two elements abut one another in the safety position.

2. A firing safety device according to claim 1, wherein said at least two barrier elements are displaced radially with respect to said transmission channel, and said at least two elements are in a safety position of said device when in mutual contact at a zone positioned opposite said transmission channel.

3. A firing safety device according to claim 2, wherein said barrier elements incorporate profiles at their contact zone with a matching shape whose juxtaposition constitutes at least one deflector ensuring gastightness for the gases generated by said igniter.

4. A firing safety device according to claim 2, wherein said at least two elements are in the shape of cylindrical sectors.

5. A firing safety device according to claim 4, wherein said firing device includes four sector-shaped elements.

6. A safety device according to claim 2, wherein said at least two barrier elements are substantially parallelepipedic in shape, and wherein an axis of said transmission channel passes through a transversal plane P of one of said at least two elements at the thinnest section of the one element.

7. A firing safety device according to claim 1, wherein said at least two barrier elements are positioned one on top of the other and opposite said transmission channel, each of the at least two elements incorporating slots separated by tongues, said tongues of a first of at least two elements blocking said slots in a second of at least two elements when said device is in a safety position and said tongues uncovering said slots when said device is in the armed position.

8. A firing safety device according to claim 7, wherein said transmission channel has a section whose surface area is less than or equal to 1 $mm^2$ when chosen to be greater than a priming surface of said pyrotechnic charge.

9. A firing safety device according to claim 1, wherein said transmission channel has a section whose surface area is less than or equal to 1 $mm^2$ when chosen to be greater than a priming surface of said pyrotechnic charge.

10. A firing safety device according to claim 9, wherein said at least two elements and said motor are made in the form of micro-machined or micro-engraved parts, added onto or made in a board of a substrate.

11. A firing safety device according to claim 1, wherein said at least two elements and said motor are made in the form of micro-machined or micro-engraved parts, added onto or made in a board of a substrate.

12. A safety device according to claim 11, wherein said device includes at least two said micro-machined or said micro-engraved boards stacked one on top of the other, and a control means for ensuring a synchronized displacement of said at least two elements of each of said board.

* * * * *